US008346144B2

(12) United States Patent
Takagi et al.

(10) Patent No.: US 8,346,144 B2
(45) Date of Patent: Jan. 1, 2013

(54) IMAGE FORMING APPARATUS HAVING A CLEANER MOVABLE TOWARD AND AWAY FROM A ROTATABLE MEMBER FORMING A FIXING NIP

(75) Inventors: Kenji Takagi, Mishima (JP); Takashi Yano, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 278 days.

(21) Appl. No.: 12/794,958

(22) Filed: Jun. 7, 2010

(65) Prior Publication Data

US 2010/0310288 A1 Dec. 9, 2010

(30) Foreign Application Priority Data

Jun. 9, 2009 (JP) ..... 2009-138291

(51) Int. Cl.
*G03G 15/20* (2006.01)

(52) U.S. Cl. ..... 399/327; 399/122

(58) Field of Classification Search ..... 399/82–85, 399/122, 123, 320, 327
See application file for complete search history.

(56) References Cited

U.S. PATENT DOCUMENTS 7,178,891 B2 * 2/2007 Takamiya ..... 347/5
7,623,820 B2 * 11/2009 Nada et al. ..... 399/358

FOREIGN PATENT DOCUMENTS

| | | | |
|---|---|---|---|
| JP | 5-224555 | A | 9/1993 |
| JP | 9-80956 | A | 3/1997 |
| JP | 2001-5325 | A | 1/2001 |
| JP | 2007-199389 | A | 8/2007 |
| JP | 2007-232899 | A | 9/2007 |
| JP | 2070-304180 | A | 11/2007 |
| JP | 2008-281606 | A | 11/2008 |

* cited by examiner

*Primary Examiner* — Hoan Tran
(74) *Attorney, Agent, or Firm* — Fitzpatrick, Cella, Harper & Scinto

(57) ABSTRACT

An image forming apparatus includes an image former for forming an unfixed toner image on a recording material, and a fixer for fixing the unfixed toner image on the recording material. The fixer includes a rotatable member for forming a fixing nip for nipping and feeding the recording material, and a cleaner, movable toward and away from the rotatable member, for cleaning the rotatable member. The apparatus is operable in a blankless image formation mode for forming the toner image without a blank at least at one of a leading end and a trailing end of the recording material. The cleaner contacts the rotatable member when a portion of the rotatable member in a blankless range at the leading end or the trailing end of the recording material reaches a position where the portion opposes the cleaner.

3 Claims, 12 Drawing Sheets

(a)

(b)

IMAGE FORMING APPARATUS HAVING A CLEANER MOVABLE TOWARD AND AWAY FROM A ROTATABLE MEMBER FORMING A FIXING NIP

FIELD OF THE INVENTION AND RELATED ART

The present invention relates to an electrophotographic type image forming apparatus, such as a laser printer and a copying machine, and particularly, it relates to a control for cleaning means for cleaning the surface of a fixing member of a fixing means for heating and melting toner and fixing it on a recording material.

In an image forming apparatus for forming an image on a recording material using an electrophotographic system, the image forming apparatus that has a frameless printing function for forming an image on an entire area of the recording material is known. For example, Japanese Laid-open Patent Application 2007-199389 discloses an apparatus, in which a toner image larger than the recording material is formed on an image bearing member and an intermediary transfer member, the toner image is transferred onto the entire area of the recording material, and the toner image on the recording material is nipped and fed by a fixing nip of a fixing device to be fixed on the recording material. Here, in the fixing nip of the fixing device, in nipping and feeding the recording material, the toner may be deposited on a fixing member (a fixing roller, a fixing film, and a pressing roller or the like) which forms the fixing nip, and the deposited toner may contaminate the recording material.

Referring to (*a*) and (*b*) of FIG. 2, this problem will be schematically described. Part (*a*) of FIG. 2 is a schematic illustration illustrating an image surface 11*a*, and cut ends at a leading end and a trailing end of a recording material 11 after the toner image is transferred onto the recording material from the image bearing member or the intermediary transfer member in the frameless printing. In the frameless printing, the toner 11*t* may be deposited not only on the image surface of the recording material 11, which is to be formed in the image 11*a*, but also on the cut end portion 11*b* of the leading end and/or the trailing end of the recording material 11.

In such a case, as shown in (*b*) of FIG. 2, in a fixing process, the toner 11*t* deposited on the cut end portion 11*b* of the recording material 11 is deposited onto a heating roller 31 and a pressing roller 32 which constitutes the fixing members forming the fixing nip, or around a fixing nip. Thereafter, the toner 11*t* deposited on the heating roller 31 and the pressing roller 32 is again deposited onto the recording material 11 (offset), and as a result it contaminates the recording material after the one or several full-turns of the heating roller 31 and the pressing roller 32. Part (C) of FIG. 2 illustrates an example of a toner contamination occurred due to the offset of the toner 11*t* deposited on the heating roller 31. The contaminations by the toner 11*t* are produced at the intervals of the one full turn (L) of the heating roller 31, from the leading end of the recording material 11.

In order to avoid an image defect by the toner contamination of the fixing device at the time of such a frameless printing, for example in Japanese Laid-open Patent Application 2007-304180, a cleaning member for cleaning the fixing member which constitutes the fixing nip is provided. The cleaning member comprises a cleaning roller composed of a solid aluminum and a felt cleaning pad of a heat resistive fiber, for example, and it is pressed against the fixing member to remove the contamination, such as the toner or a paper dust, deposited on the fixing member.

In Japanese Laid-open Patent Application 2007-304180, since the cleaning member continues contacting the fixing member, the toner contamination deposited on a recording material cut end portion can be prevented, at the time of the frameless printing. However, the amount of the collectable toner by cleaning member has a limitation, and in the case where this limitation is reached, the cleaning power decreases, with the result that the contamination remains on the fixing member. Then, the cleaning member discharges the contamination to contaminate the fixing member, with the result that a satisfactory cleaning property is not assured. Therefore, in the case where the cleaning means is provided in a fixing portion, it is important that the cleaning means is used in a range capable of collecting the toner.

As a method of solving such a problem, Japanese Laid-open Patent Application Hei 5-224555, for example discloses that the timing at which the cleaning member contacts the fixing member is limited, to reduce the amount of the toner collected by the cleaning means. More specifically, during the sheet processing of the recording material, the cleaning member is spaced from the fixing member, and the cleaning member is contacted to the fixing member at a timing other than during the sheet processing of the recording material. By this, the toner contamination deposited on the fixing member during the sheet processing of the recording material is not collected by the cleaning member, but it is collected by the passing recording material per se (self cleaning).

The cleaning member removes the toner contamination deposited on the fixing member after the self cleaning by the recording material, and therefore, the amount of the toner collected by the cleaning member can be reduced also during the sheet processing of the recording material, as compared with the case of the contact. Therefore, the time at which the cleaning member reaches the limits (toner saturation zone) of its cleaning and collecting capability can be delayed, and the lifetime of the cleaning means can be prolonged, and therefore the running cost of the apparatus can be reduced.

However, in Japanese Laid-open Patent Application Hei 5-224555, the cleaning member is spaced from the fixing member during the sheet processing, and therefore, the toner contamination attributable to the offset of the toner deposited on the recording material cut end portion at the time of the frameless printing cannot be prevented. More particularly, as shown in (*a*) and (*b*) of FIG. 2, it is not possible that the toner 11*t* deposited on the heating roller 31 and the pressing roller 32 is removed from the rollers before the offset re-deposits onto the recording material. As a result, the recording material 11 is contaminated with the possible result of producing an image defect.

Particularly, at the time of the frameless printing, in the case where the toner 11*t* deposited on the cut end portion 11*b* of the leading end or the trailing end of the recording material is deposited on the heating roller 31 which is the fixing member, it appears as an image defect in the form of horizontal lines on the recording material 11, as shown in (*b*) of FIG. 2. For this reason, the image defect is conspicuous, depending on the image in a background, and therefore, image quality decreases.

On the other hand, in the case where the cleaning member continues contacting the fixing member during sheet processing, as shown in Japanese Laid-open Patent Application 2007-304180, the toner contamination deposited on the recording material cut end portion at the time of the frameless printing can be prevented. However, the opportunity for the self cleaning by the recording material disclosed in Japanese Laid-open Patent Application Hei 5-224555 is lost, and therefore, the toner collection amount by the cleaning member is large. Furthermore, the toner saturation zone is reached sooner, and therefore, the life of the cleaning member is shortened.

SUMMARY OF THE INVENTION

An object of the present invention is to provide an image forming apparatus in which the lifetime reduction of a cleaner can be suppressed.

Another object of the present invention is to provide an image forming apparatus, in which the toner contamination of the fixing member attributable to the toner deposited on a cut end portion of a transfer material at the time of the frameless printing can be eliminated, and a self cleaning function by the transfer material can be utilized, by which the prolongation of the life of the cleaning means can be accomplished. According to an aspect of the present invention, there is provided an image forming apparatus comprising an image forming apparatus comprising: an image forming station for forming an unfixed toner image on a recording material; a fixing station for fixing the unfixed toner image on the recording material, the fixing station including a rotatable member for forming a fixing nip for nipping and feeding the recording material, and a cleaner, movable toward and away from the rotatable member, for cleaning the rotatable member. The apparatus is operable in a frameless or blankless image formation mode for forming the toner image without a frame or blank at least at one of a leading end and a trailing end of the recording material. The cleaner contacts the rotatable member at a time at which a portion of the rotatable member that has contacted a blankless range (marginal or frame area in the case of the printing with blank or a frame) at the leading end or the trailing end of the recording material reaches a position where the portion opposes the cleaner. The cleaner also is spaced from the rotatable member in a period in which a portion of the rotatable member that has contacted the recording material in a range other than the blankless range passes the position where the portion opposes said cleaner.

According to the present invention the prolongation of the life of the cleaning means is accomplished.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Embodiment 1

Figure 1:
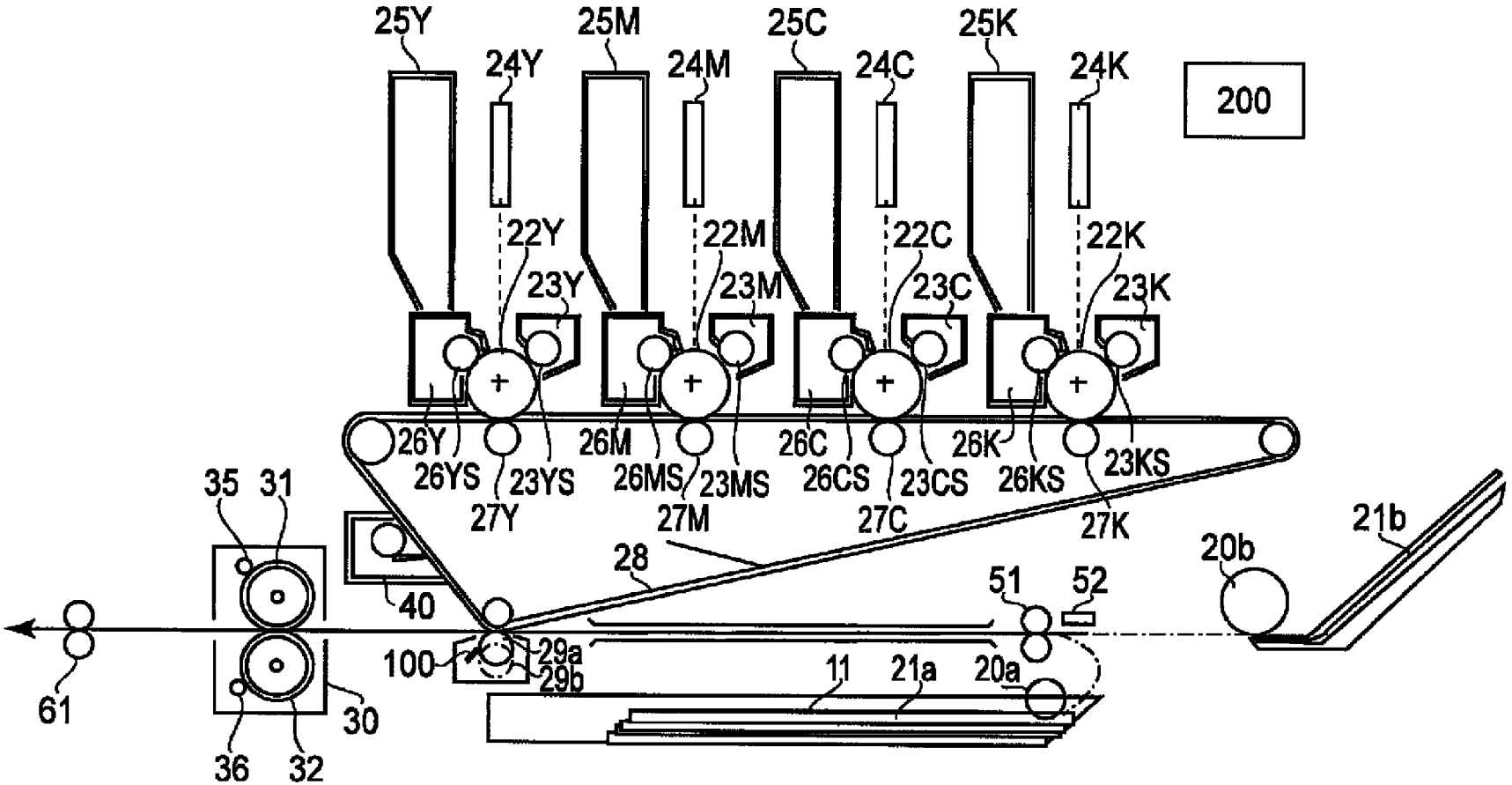
FIG. 1 is a general arrangement illustrating an image forming apparatus according to an embodiment of the present invention.

The preferred embodiments of the present invention will be described in conjunction with the accompanying drawings. FIG. 1 shows a general arrangement of a color image forming apparatus according to the embodiment of the present invention. This image forming apparatus comprises an image forming station as the image forming means for forming a toner image on the recording material 11 and a fixing portion 30 as the fixing means for heat-fixing the toner image on the recording material 11.

The image forming station forms a color image, and more particularly, an electrostatic latent image is formed by the exposure light applied on the basis of the exposure times modulated by the image processing station, and the electrostatic latent image is developed into a monochromatic toner image, and the plurality of monochromatic toner images are overlaid into a multicolor toner image. The multicolor toner image is transferred onto a recording material 11 fed from a feeding portion, and the multicolor toner image on the recording material 11 is fixed by the fixing portion 30.

Each image forming station comprises a photosensitive drum (22Y, 22M, 22C, 22K), an injection charger (23Y, 23M, 23C, 23K), a scanner portion (24Y, 24M, 24C, 24K), a toner cartridge (25Y, 25M, 25C, 25K), a developing portion (26Y, 26M, 26C, 26K), and a primary transfer roller (27Y, 27M, 27C, 27K). Also provided are an intermediary transfer member 28 and a secondary transfer roller at positions 29*a* and 29*b*. Moreover, also provided are a secondary transfer roller cleaning member for cleaning the secondary transfer roller at positions 29*a*, 29*b* and an intermediary transfer member cleaning member 40 for cleaning the intermediary transfer member 28.

A feeding system from the feeding portion to the fixing portion 30 comprises a registration roller 51, a pre-registration sensor 52, and a sheet discharging roller 61. The operation of the image forming station, the feeding portion, the fixing portion 30, and the feeding system are controlled by CPU 200. A feeding speed V of the recording material 11 is the approximately 200 mm/sec, for example. Each of the photosensitive drums (photosensitive members) 22Y, 22M, 22C, 22K includes an aluminum cylinder, an outer periphery of which is coated with an organic photoconductive layer, and it is rotated by a driving force from the unshown driving motor. The driving motor rotates the photosensitive drums 22Y, 22M, 22C, 22K in a counter-clockwise direction in accordance with the image forming operation.

The injection chargers 23Y, 23M, 23C, 23K of the image forming station are primary charging means, and the photosensitive drums for the yellow (Y), the magenta (M), the cyan (C), and the black (K) colors are charged. Each of the injection chargers 23Y, 23M, 23C, 23K is provided with a sleeve 23YS, 23MS, 23CS, 23KS, respectively. The exposure light to the photosensitive drums 22Y, 22M, 22C, 22K is sent from the scanner portions 24Y, 24M, 24C, 24K, respectively, and selectively exposes the surfaces of the photosensitive drums 22Y, 22M, 22C, 22K. By this, the electrostatic latent images are formed on the photosensitive drums 22Y, 22M, 22C, 22K, respectively.

In the developing portion, there are provided developing devices for the yellow (Y), magenta (M), cyan (C), and black (K) development 26Y, 26M, 26C, 26K for the stations to visualize the electrostatic latent images, respectively. Each of the developing devices 26Y, 26M, 26C, 26K includes a developing sleeve 26YS, 26MS, 26CS, 26KS, respectively. Developing biases are applied between the developing sleeves 26YS, 26MS, 26CS, 26KS and the corresponding photosensitive drums 22Y, 22M, 22C, 22K, respectively, from an unshown voltage source. Each of the developing devices 26Y, 26M, 26C, 26K can be dismounted.

The intermediary transfer member 28 is contacted to the photosensitive drums 22Y, 22M, 22C, 22K, and is rotated clockwise at the time of a color image formation, together with the rotations of the photosensitive drums 22Y, 22M, 22C, 22K so that four monochromatic toner images are transferred thereonto. The primary transfer bias voltages are applied between the primary transfer rollers 27Y, 27M, 27C, 27K and the corresponding photosensitive drums 22Y, 22M, 22C, 22K, respectively, from the unshown voltage source.

In the feeding portion, there is provided a sheet feeding cassette 21*a* or a sheet feeding tray 21*b*, which contains the recording materials 11. The recording material 11 is fed to the registration roller 51 by feeding rollers 20. A position of the recording material 11 is detected by the pre-registration sensor 52. The pre-registration sensor 52 is disposed in front of the registration roller. The pre-registration sensor 52 is comprises a LED and a photodetector for detecting the reflected light therefrom. When the recording material 11 reaches the neighborhood of a pre-registration sensor 52, the photodetector detects the reflected light from the LED, so that an on-state is determined, and when the recording material 11 is not adjacent to the pre-registration sensor 52, the photodetector does not detect the light, and therefore, the off-state is determined. At the time of an image formation, the feeding of the recording material 11 is stopped for predetermined time duration, corresponding to the time, the multicolor toner image on the intermediary transfer member 28 reaches the transfer roller at positions 29*a*, 29*b*, by the pre-registration sensor 52. The recording material 11 reaches the secondary transfer roller at positions 29*a*, 29*b* from the registration roller 51.

The secondary transfer roller at positions 29*a*, 29*b* contacts the intermediary transfer member 28 and the recording material 11 is nipped and fed to transfer the multicolor toner image from the intermediary transfer member 28 onto the recording material 11, and the recording material 11 is fed to the fixing portion 30. During the transferring of the multicolor toner image onto the recording material 11, the secondary transfer roller is contacted to the recording material 11 at the position 29*a*, and is spaced to the position 29*b* after the printing process. A secondary transfer bias voltage is applied between the secondary transfer roller and an intermediary transfer member 28 from the unshown voltage source. The secondary transfer roller cleaning member 100 scrapes the contamination of the secondary transfer roller off to clean it, and it is made of a urethane rubber blade.

The fixing portion 30 is provided with a fixing roller 31 and a pressing roller 32 which are a pair of fixing members which form a fixing nip for heat-fixing the toner image on the recording material, and while it feeds the recording material 11, it fuses and fixes the transferred multicolor toner image. The fixing roller 31 heats the recording material 11, and the pressing roller 32 press-contacts the recording material 11 to the fixing roller 31. The recording material 11 which stores the multicolor toner image receives the heat and the pressure by the fixing roller 31 and the pressing roller 32, so that the toner is fixed on the surface, and the recording material 11 is fed to the sheet discharging roller 61. The sheet discharging roller 61 discharges the recording material 11 to an unshown sheet discharge tray, and the image forming station finishes a series of image forming operations.

A description will be provided as to printing operations in a print mode with the blank, and frameless printing mode according to this embodiment. In this image forming apparatus, in the case where it carries out printing in the print mode with the blank or frame on the recording material 11, as shown in (*a*) of FIG. 3, a masking area E which regulates a printing area of the recording material 11 is set in a range smaller than a range P of the recording material 11. Therefore, an image in the range smaller than the recording material 11 is formed on the photosensitive drum 22, and the image is transferred onto the recording material 11 through the intermediary transfer member 28 with the blank.

Figure 3:
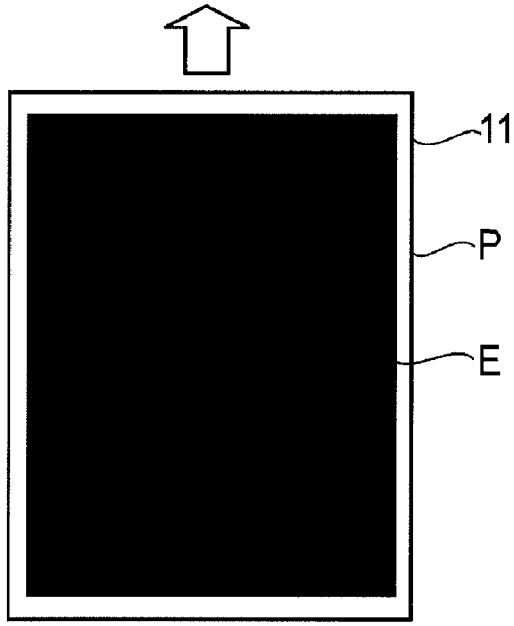
FIG. 3 illustrates a relation among a recording material, a masking area, an additional printing area in the frameless printing.
Figure 3:
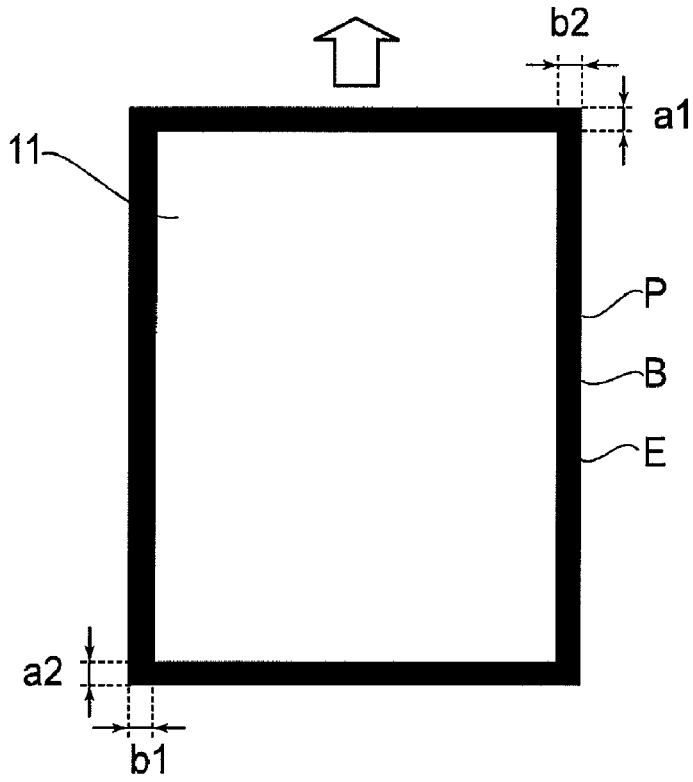

In the case where the image is formed in frameless printing mode on the recording material 11, as shown in (*b*) of FIG. 3, the masking area E of the recording material 11 is set in a larger range by an amount corresponding to the additional printing area B than the range P of the recording material 11. The additional printing area B has widths a1, a2, b1, and b2 in a leading end, a rear end portion, a left-hand end portion, a right-hand end portion of the image, respectively. Therefore, on the photosensitive drum 22, an image is formed that covers the masking area E, which includes the additional printing area B, that is, an area larger than the recording material 11, and the image is transferred onto the recording material 11 through the intermediary transfer member 28 to provide a frameless or blank-less image. The widths a1, a2, b1, b2 are approx. 2 mm, for example. At the time of a secondary transfer, a part of a toner in the additional printing area outside the recording material 11 is deposited onto the secondary transfer roller. The deposited toner is removed by the secondary transfer roller cleaning member 100 which is in contact to the secondary transfer roller.

Figure 2:
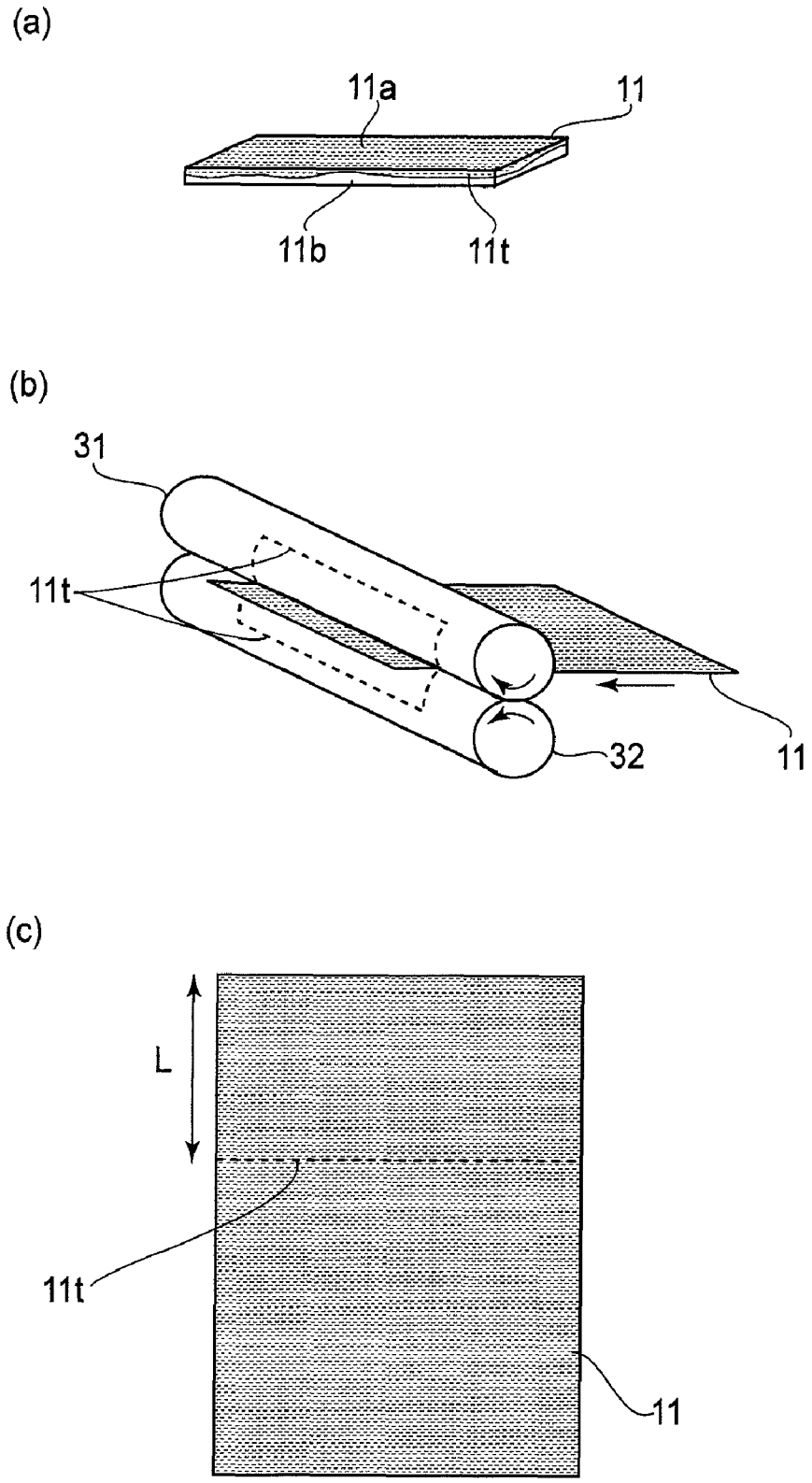
FIG. 2 is an illustration of a toner contamination in the frameless printing.

On the other hand, in a secondary transfer portion, as shown in (*a*) of FIG. 2, on the recording material 11 which has finished a secondary transfer step, the toner is transferred not only on the surface but also on a part of the cut end portion, which is the cut surface portions in the circumference surrounding the edge. When the recording material 11 enters the fixing portion 30, in the fixing nip, as shown in (*b*) of FIG. 2, the toner on the cut end portion of the recording material is unfixed, and therefore, the toner offsets onto the surfaces of the fixing roller 31 and the pressing roller 32. When the toner is deposited on surfaces of the fixing roller 31 and the pressing roller 32, contamination occurs on the surface and the back side of the recording material 11 as shown in (*b*) of FIG. 2. Since it appears as an image defect in the form of the horizontal lines, the offset toner of the toner deposited on a cut end portion of a leading end and the trailing end of the recording material is conspicuous.

Figure 4:
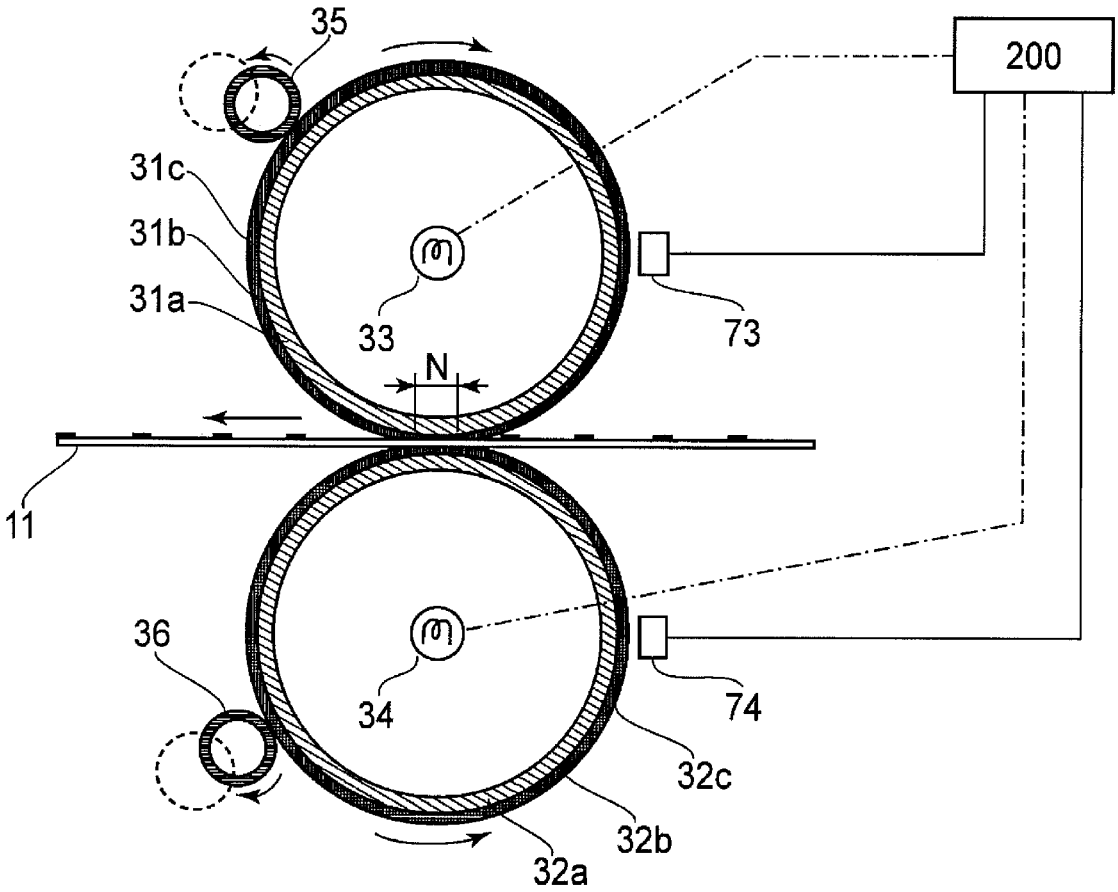
FIG. 4 illustrates a basic structure of a fixing portion in the image forming apparatus of FIG. 1.

In this embodiment, the offset toner, produced by the toner deposited on the cut end portion of the leading end and the trailing end of the recording material, is removed, by which the image defect is prevented, and, a self cleaning by the recording material by itself can be performed. Here, a detailed description will be provided as to the fixing portion in the image forming apparatus according to this Embodiment 30. FIG. 4 shows a basic structure of the fixing portion. As described above, the fixing portion 30 is provided with the fixing roller 31 and the pressing roller 32 which constitutes the pair of fixing members (rotatable members). A cleaning roller (cleaner) 35 is provided for at least one side of the fixing members. On the other hand, in this example, there are provided cleaning rollers 35, 36 as cleaning means for cleaning the fixing roller 31 and the pressing roller 32, respectively. The cleaning rollers 35, 36 are movable to and away relative to the fixing roller 31 and the pressing roller 32, respectively, and they are contacted to the surfaces of the fixing roller 31 and the pressing roller 32 to remove and collect the toner.

The fixing roller 31 has a hollow metal core 31*a* as a base layer, which is coated with an elastic layer. For example, the metal core 31*a* has a thickness of 2.0 mm, is made of Fe, and is coated with a silicone rubber of 2 mm thick. The outermost layer is composed of a fluorinated resin material of a thickness of 50 micrometers, as a toner parting layer. The fixing roller 31 has an outer diameter of 35 mm. The pressing roller 32 has the structure similar to the fixing roller 31. It has an Fe hollow metal core 31*a* of a thickness of 2.0 mm as the base layer, which is coated with silicone rubber as the elastic layer having a thickness of 2 mm. The outermost layer is composed of a fluorinated resin material of a thickness of 50 micrometers as a toner parting layer. The outer diameter of the pressing roller 32 is 35 mm similarly to the fixing roller 31. The pressing roller 32 forms a fixing nip N for pressing at a predetermined pressure relative to the fixing roller 31, and heating and melting the toner onto the recording material 11, by an unshown spring and a supporting member.

The fixing roller 31 and the pressing roller 32 have hollow configurations, and the insides thereof are provided with the heaters 33, 34 such as a halogen heater. The heater 33 and 34 heat the fixing roller 31 and the pressing roller 32, respectively. The surface temperatures of the fixing roller 31 and the pressing roller 32 are detected by thermopiles 73, 74 which are non-contact type temperature sensors, respectively. The thermopiles 73, 74 are disposed opposed to a roller surface, and the data detected by thermopiles 73, 74 is converted by A/D conversion with the CPU 200. The CPU200 determines the ON/OFF state of the halogen heaters 33, 34 based on the result of the temperature detection to carry out the temperature control, so that the surface temperatures of the fixing roller 31 and the pressing roller 32 are maintained at the predetermined temperature (approx. 180□).

Each of the cleaning rollers 35, 36 as the cleaning means has the aluminum pipe, which is coated with a nonwoven fabric of the thickness of 2 mm and is made of by aramid resin fiber, and the outer diameter thereof is 9 mm. At predetermined timing as will be described hereinafter, the cleaning rollers 35, 36 are contacted at a predetermined pressure relative to the fixing roller 31 or the pressing roller 32, and the toner contaminating the roller is attracted to the cleaning rollers 35, 36 and those rollers are cleaned. Here, referring to FIG. 5, a detailed description will be provided as to an operating mechanism for the fixing portion 30. The pressing roller 32 is driven by the fixing roller 31. Therefore, from an image forming apparatus main assembly, the fixing roller 31 and the pressing roller 32 are driven by a gear (unshown) disposed at the end of a fixing roller 31, and are rotated thereby.

The cleaning rollers 35, 36 are disposed on the downstream sides of the fixing nip N formed by the fixing roller 31 and the pressing roller 32 with respect to the respective peripheral surface movement directions, and the circumferential distances from the fixing nip N are the same. The cleaning rollers 35, 36 are rotatably supported by the frames 72, 82, respectively, using flanges for the supporting shafts press-fitted into the opposite ends of an aluminum pipe. Ends of frames 72, 82 are rotatable relative to the shafts 71, 81 provided in a fixing portion frame 80. By rotating the frames 72, 82 about the shafts 71, 81, the cleaning rollers 35, 36 are contacted to and spaced from the fixing roller 31 and the pressing roller 32, respectively.

Figure 5:
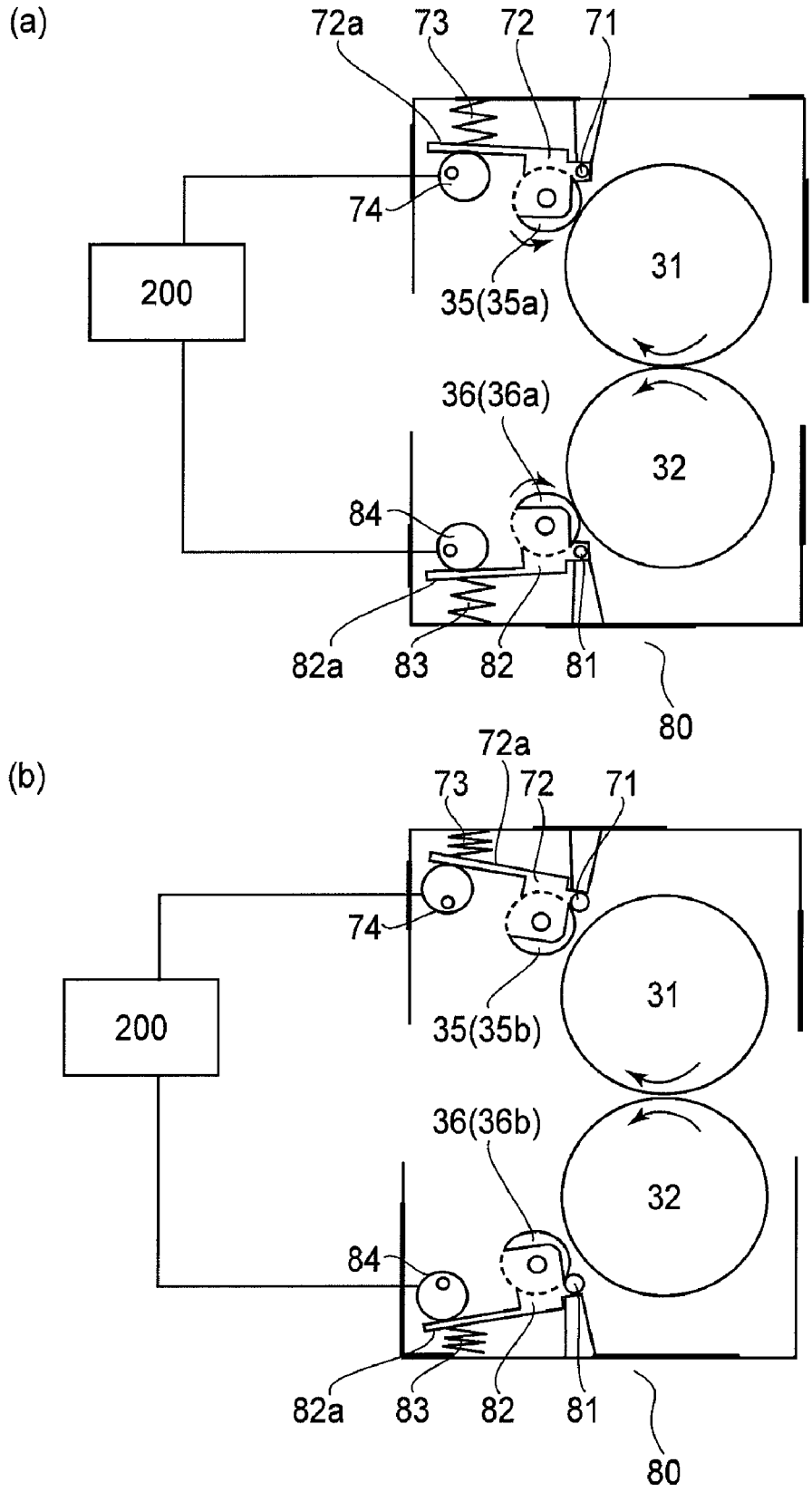
FIG. 5 illustrates an operating mechanism for the fixing portion of FIG. 4.

A contacting and spacing state of each of the cleaning rollers 35, 36 is controlled by the cams 74, 84, respectively, which constitute a part of fixing cleaning control means of FIG. 5(*a*). The cams 74, 84 are rotatably supported by the fixing portion frame 80, and are in contact to levers 72*a*, 82*a* provided to the frames 72, 82, respectively. When the cams 74, 84 rotate to predetermined positions, levers 72*a*, 82*a* of the frames 72, 82 supporting each of the cleaning rollers 35, 36 are urged by the compression springs 73, 83, respectively, fixed to the fixing portion frame 80 (counterclockwise in FIG. 5(*a*)). By the urging force, the cleaning rollers 35, 36 are contacted to the fixing roller 31 and the pressing roller 32 through the frames 72, 82, respectively ((*a*) of FIG. 5). Designated by reference characters 35*a*, 36*a* are the contact positions of the cleaning rollers 35, 36. The cleaning rollers 35, 36 receive the driving forces from the fixing roller 31 and the pressing roller 32 in the contact positions, respectively to be driven ((*a*) of FIG. 5).

When the cams 74 and 84 rotate to predetermined spaced positions, the frames 72 are 82 are pushed up so that the contact, to the fixing roller 31 and the pressing roller 32, of the cleaning rollers 35, 36, respectively, is released to be capable of being spaced. Designated by reference characters 35*b*, 36*b* are the spacing positions of the cleaning rollers 35, 36, respectively ((*b*) of FIG. 5). The cams 74, 84 are rotationally driven by a cam driving mechanism such as an unshown motor, and the CPU200 controls contacting and spacing timing. A control of this contacting and spacing timing is carried out, in the case where the frameless printing operation is executed, on the basis of the positions on the fixing roller 31 and the pressing roller 32 corresponding to the recording material cut end portions of the leading end and the trailing end of the recording material. More particularly the cleaning rollers 35, 36 are contacted to the fixing roller 31 and the pressing roller 32, respectively, at the timing at which the positions corresponding to the cut end portions reach the contact positions to the cleaning rollers 35, 36. Furthermore, the contacting and spacing states of the cleaning rollers 35, 36 are controlled, such that the cleaning rollers 35, 36 are spaced from the fixing roller 31 and the pressing roller 32, respectively, after the positions corresponding to the cut end portion pass the contact positions of the cleaning rollers 35, 36.

Figure 6:
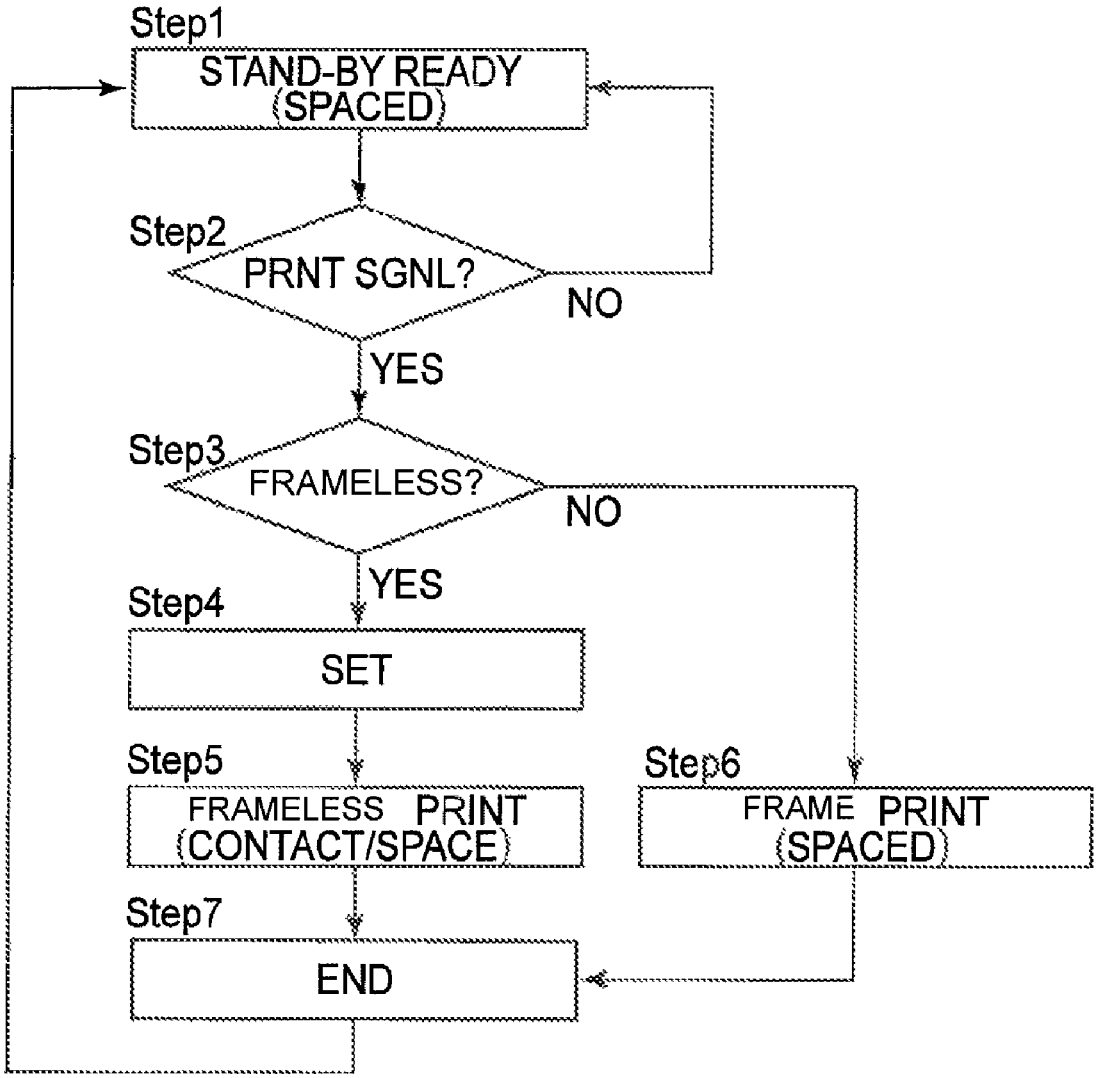
FIG. 6 is a flow-chart illustrating the operation control of the fixing portion according to Embodiment 1.
Figure 7:
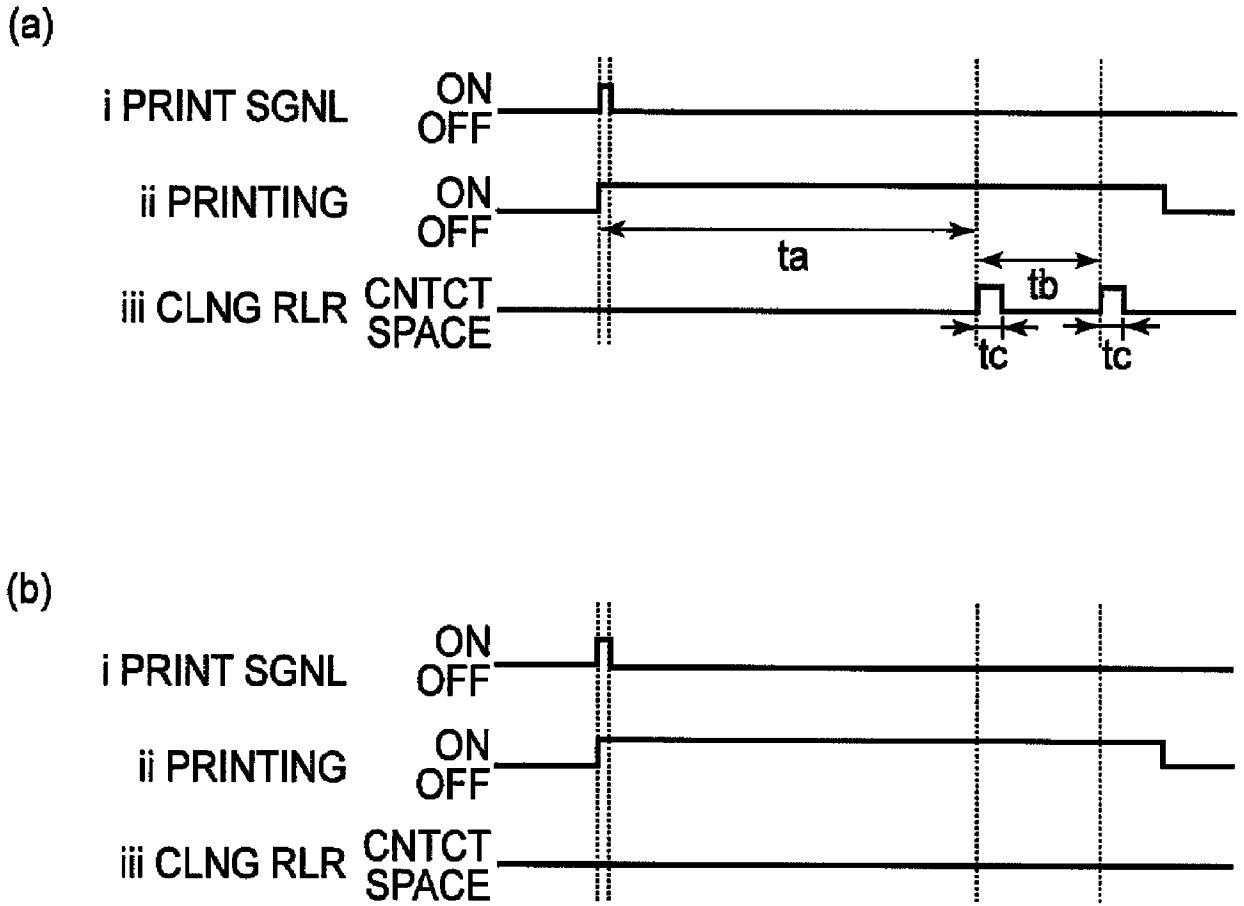
FIG. 7 is a timing chart of operation control timing of the fixing portion according to Embodiment 1.

Referring to FIGS. 6 and 7, a detailed description will be provided as to the operation control of the fixing portion 30. FIG. 6 is a flow-chart which shows the operation control for the fixing portion 30 in this embodiment. The control is executed by the CPU 200.

Step1: When the image forming apparatus is in a stand-by ready state, the cleaning rollers 35, 36 are in the spacing state ((*b*) of FIG. 5). Step 2: The stand-by ready state is continued to the reception of the printing signal. Step 3: When the printing signal is received, the different control is carried out, depending on whether the signal designates a frameless printing mode or a print mode with the frame or a blank. Step 4: In the case of the frameless printing mode designation, the CPU 200 sets the cleaning roller set times ta, tb, tc. As for the times ta, tb, tc, a detailed description will be provided referring to FIG. 7. Step 5: The image forming apparatus executes the frameless printing operation. Step 6: The image forming apparatus executes the printing operation with a blank. In this case, the cleaning rollers 35, 36 are normally spaced from the fixing roller, and the pressing roller, respectively. Step 7:

When the frameless printing operation or the printing operation with the blank is completed, the operation returns to the stand-by ready state Step 1.

FIG. 7 is a timing chart which shows the operation and the control of the image forming apparatus main assembly and the fixing portion 30 in this embodiment. In the state of i, the image forming apparatus is in the stand-by state until it receives the printing signal, and the cleaning rollers 35, 36 are in the spacing state. In the state of i, the CPU200 in the image forming apparatus receives the printing signal and a signal designating frameless printing mode ((*a*) of FIG. 7), and in the state of ii, the image forming apparatus carries out the frameless printing operation at the timing.

At the timing of iii, the contact/separating operation of the cleaning rollers 35, 36 is controlled in accordance with the operation timing of ta, tb, tc shown in step 4 of FIG. 6, by which the offset toner at the leading end and the trailing end of the recording material is removed. The times ta, tc are the constants stored in ROM in CPU200 beforehand. The time ta is the time from the reception of the printing signal to the contacting operation of the cleaning rollers 35, 36. This time ta is the time until the toner contamination by the recording material leading end deposited on the fixing roller 31 or the pressing roller 32 reaches the contact positions of the cleaning rollers 35, 36, and the cleaning rollers 35, 36 are shifted to a first contact state.

The time tb is the feeding time calculated on the basis of the length, with respect to the feeding direction, of the recording material 11 and the feeding speed. The cleaning rollers 35, 36 are shifted to a second contact state at the timing ta+tb at which the toner contamination of the recording material trailing end deposited on the fixing roller 31 or the pressing roller 32 reaches the contact positions of the cleaning rollers 35, 36. The time tc is a contact period of the cleaning rollers 35, 36, and after the elapse of the time tc, the cleaning rollers 35, 36 return to the spacing states. In state i, when CPU200 in the image forming apparatus receives the printing signal, and, in the case where the print mode with the blank is selected, ((*b*) of FIG. 7), the image forming apparatus executes the frameless printing operation in state iii. As has been described in Step 6 of FIG. 6, the cleaning rollers 35, 36 are normally spaced from the fixing roller 31 and the pressing roller 32, respectively. As has been described in the foregoing, each cleaner contacts one of the rotatable members at the time at which the portion of one of the rotatable members that has contacted a blank-less range of the leading end or the trailing end of the recording material reaches a position opposed to the cleaner, and each cleaner is spaced from one of the rotatable members during the period in which the portion of the rotatable member that has contacted the recording material in a range other than the blank-less range passes the opposed position.

Table 1 shows a comparison in the property with respect to the items 1)-5) in the comparison examples 1, 2 and this embodiment. Comparison example 1 is a cleanerless system. In comparison example 2, the cleaning roller according to the embodiment is normally contacted, and Embodiment 1 in this embodiment. In the Embodiment 1, ta=0.5 sec, tb=0.5 sec (recording material length=100 mm, feeding speed=from 200 mm/sec), tc=0.1 sec. In the Table, items 2) and 4) are an actual measurement data of amounts of toner depositions to each cleaning roller per one recording material. These are the results of the case in which the toner amount per unit area in the additional printing area is 1.2 mg/cm$^2$ in this embodiment. Item 3) and 5) are the durable lifetime numbers of the cleaning roller, which are calculated based on the actual measurements of 2) and 4) and a cleaning capacity (toner amount which the cleaning roller can collect) of the cleaning roller in the embodiment.

TABLE 1

| | A. Prior Art (without cleaner) | B. Prior Art (always in contact) | C. Embodiment 1 |
|---|---|---|---|
| i) Image defects by off-set toner at leading and trailing edges | Yes | No | NO |
| ii) Toner amounts on cleaning roller 35 (measurements) | | 0.12 mg | 0.02 mg |
| iii) Durabilities (calculated) | | 36000 sheets | 216000 sheets |
| iv) Toner amounts on cleaning roller 36 | | 0.08 mg | 0.01 mg |
| v) Durabilities (calculated) | | 54000 sheets | 432000 sheets |

A description will be provided as to item 1) which indicates the presence or absence of the production of the image defect due to the offset toner in the leading end and the trailing end of the recording material at the time of the frameless printing. In the case of the comparison example 1, since the cleaning roller, which is the cleaning means, is not employed, an image defect occurs. However, in the case of the comparison example 2 and Embodiment 1, the cleaning roller which is the cleaning means is employed, and the toner contamination can be removed, and therefore, the image defect does not occur. The amount of toner depositions to each cleaning roller (item 2) and 4)) is smaller than in the comparison example 2 in Embodiment 1. In Embodiment 1, the contact timing of the cleaning roller is limited and the toner contamination on the surface of paper is removed by the self cleaning. By this, as shown in the comparison example 2, the toner collection amount decreases as compared with the case of always contacting the cleaning roller which is the cleaning means. As a result, it is understood that the durable lifetime number of sheets produces using items 3) and 5) of each cleaning roller in Embodiment 1 is much larger than in the comparison example 2, and therefore, the life time prolongation of the cleaning roller can be accomplished.

As has been described in the foregoing, by a cleaning control by the cleaning roller of the fixing portion employed in this embodiment, an image defect (offset) attributable to the offset toner deposited on the cut end portions of the leading end and a trailing end of the recording material at the time of the frameless printing can be prevented. By this, satisfactory images can be provided. As to the toner contamination that occurs from causes other than roller contact with the leading end and the trailing end of the recording material, the cleaning rollers 35, 36 are spaced from the fixing roller 31 and the pressing roller 32, respectively, and the toner contamination is removed by the self cleaning of the recording material by itself. For this reason, the toner deposition to the cleaning rollers 35, 36 can be reduced. Therefore, the cleaner reaches the toner saturation zone later. As a result, the life time prolongation and the reduction of a replacement cycle can be accomplished.

Embodiment 2

The image forming apparatus relating to Embodiment 2 of the present invention will be described. In the description of this embodiment, the same reference numerals as in Embodiment 1 are assigned to the elements having the corresponding functions in this embodiment, and the detailed description thereof is omitted for simplicity. In this embodiment, operation control of the fixing portion 30 is different from Embodiment 1, and in this embodiment, the pre-registration sensor 52 functioning as the recording material detecting means is used for the purpose of the improvement of the accuracy of the timing of the contact/spacing of the cleaning rollers 35, 36. The pre-registration sensor 52 is provided before the fixing portion in the sheet passage. More particularly pass timing of the recording material is detected by the pre-registration sensor 52, and the contact timing of the cleaning rollers 35, 36 is determined on the basis of the result of detection.

Figure 8:
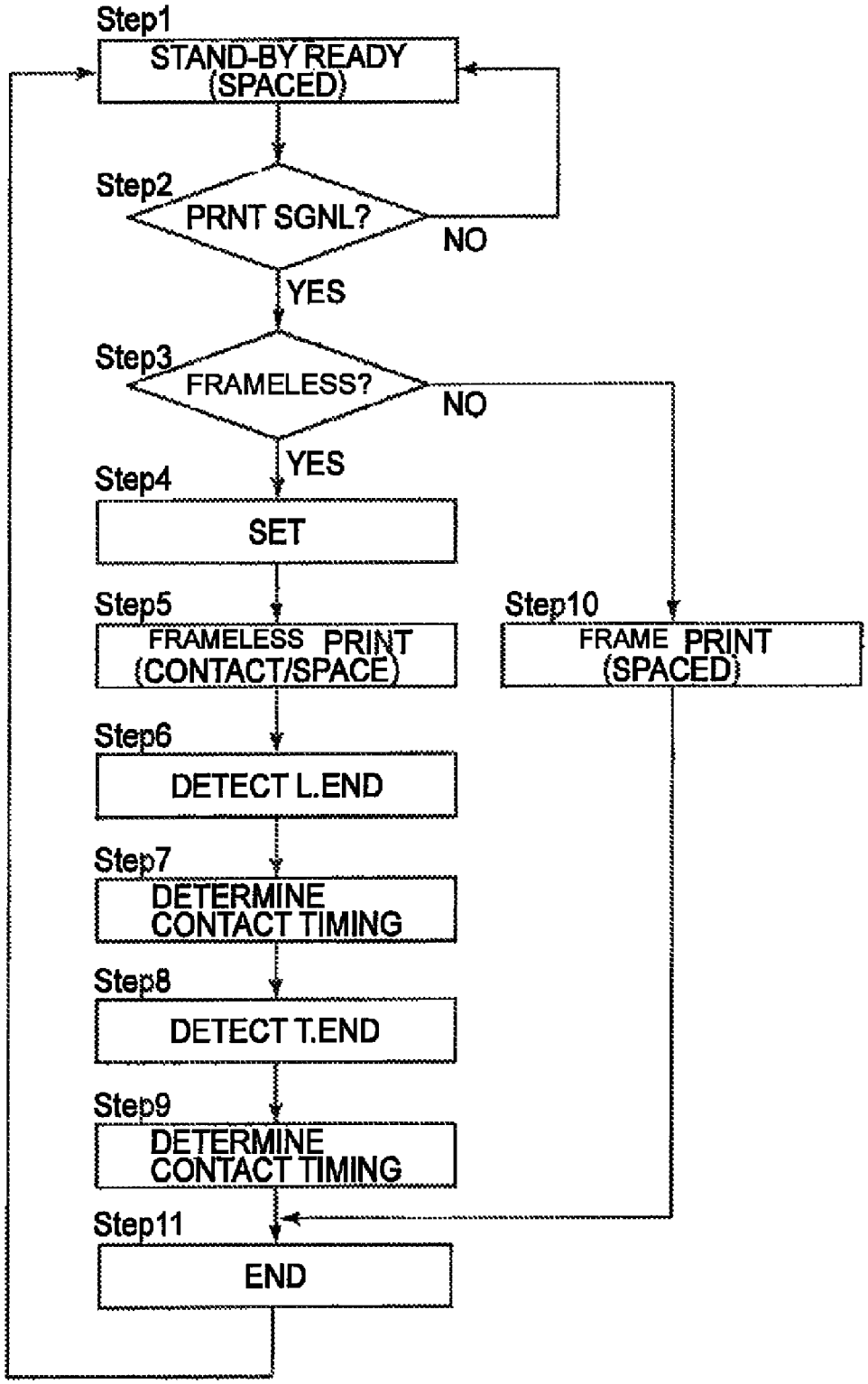
FIG. 8 is a flow-chart illustrating the operation control of the fixing portion relating to Embodiment 2.
Figure 9:
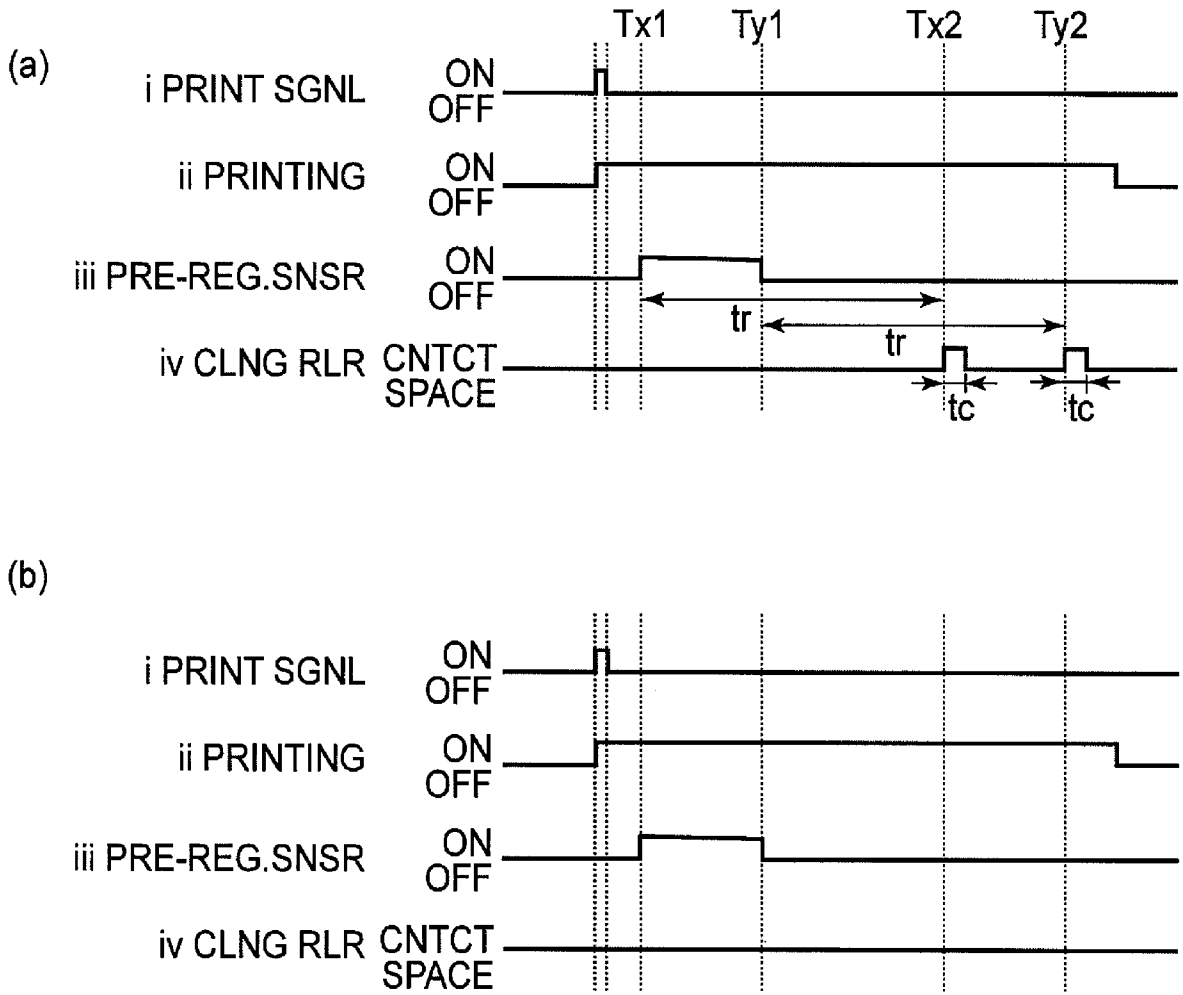
FIG. 9 is a timing chart of the operation control timing of the fixing portion relating to Embodiment 2.

Referring to FIGS. 8 and 9, a description will be provided, as to the operation control of the fixing portion 30 of the image forming apparatus relating to Embodiment 2. FIG. 8 is a flow-chart of the operation control for the fixing portion 30 in this embodiment. This control is also executed by the CPU 200 which is the controller CPU200.

Step 1: When the image forming apparatus is in the stand-by ready state, the cleaning rollers 35, 36 are in the spacing states ((*b*) of FIG. 5).

Step 2: The stand-by ready state is continued until the printing signal is received.

Step 3: When the printing signal is received, the different control is carried out, depending on whether the signal thereof designates a frameless printing mode, or a print mode with a frame or blank.

Step 4: In the case where the frameless printing mode is designated, CPU200 sets cleaning roller set times tc and tr. Tc is similar to Embodiment 1, and tr is a constant stored in ROM in CPU200. The time tc is the feeding time determined on the basis of the length from the pre-registration sensor 52 to the contact positions of the cleaning rollers 35 and 36 in the fixing portion (30) in the feeding direction.

Step 5: The frameless printing operation of the image forming apparatus in the present Embodiment 2 is executed.

Step 6: After the printing operation execution, the recording material 11 is fed from the feeding portion, and timing Tx1 at which the pre-registration sensor 52 becomes ON is detected.

Step 7: Tx2 is the timing tr after the timing Tx1.

Step 8: After the printing operation execution, the recording material 11 is fed from the feeding portion, and timing Ty1 at which it becomes again Off is detected after the pre-registration sensor 52 once becomes On.

Step 9: Ty2 is the timing tr after the timing Ty1.

Step 10: The blank printing operation of the image forming apparatus in this embodiment is executed. In this case, the cleaning rollers are normally spaced from the fixing roller and the pressing roller.

Step 11: When the frameless printing operation or the blank printing operation is completed, the operation returns to the stand-by ready state Step 1.

FIG. 9 is a timing chart which shows the operation control of the image forming apparatus main assembly and the fixing portion 30 in Embodiment 2. At timing 1, the image forming apparatus is in the stand-by state, and the cleaning rollers 35, 36 are in the spaced state, until the printing signal is received. At this timing 1, the CPU200 in the image forming apparatus receives the printing signal, and when the frameless printing mode is set, ((*a*) of FIG. 9), the image forming apparatus carries out the frameless printing operation at timing 2. In the period 3, the contact/separating operation of the cleaning rollers 35, 36 is controlled at the operation timing shown in Step 4-Step 9 of FIG. 8. By this, the contact timing of the cleaning rollers 35, 36 is determined, on the basis of the result of detection of the pre-registration sensor 52, and the offset toner of the leading end and the trailing end of the recording material is removed.

At the timing 1, as a result of the CPU200 in the image forming apparatus receiving the printing signal, when blank print mode is set, (FIG. 9 (*b*)), the image forming apparatus carries out the frameless printing operation at the timing 2. As described in Step 10 of FIG. 8, the cleaning rollers 35, 36 are normally spaced from the fixing roller 31 and the pressing roller 32.

The table 2 shows the defective image incidences per 10000 of the processed recording materials 11 in Embodiment 1 and Embodiment 2. Here, only the off-set toner contamination at the cut end portion of the leading end and the trailing end of the recording material counts as the image defect. In this embodiment, tc=0.1 sec, and tr=0.4 sec.

TABLE 2

| | C. Embodiment 1 | D. Embodiment 2 |
|---|---|---|
| Image defect incidence per 10000 sheets | 0.25% (25/10000) | 0.08% (8/10000) |

From table 2, it is understood that the defective image incidence is lower in Embodiment 2 than in Embodiment 1. This is because the leading end and the trailing end of the recording material is detected using the pre-registration sensor 52, by which the contact timing of the cleaning rollers 35, 36 relative to the fixing roller 31 and the pressing roller 32 is determined with higher accuracy. In the present Embodiment 2, the cleaning control by the cleaning rollers 35, 36 is carried out on the basis of the result of detection of the pre-registration sensor 52, by which the cleaning of the fixing roller 31 and the pressing roller 32 can be carried out more assuredly and accurately than in Embodiment 1. As a result, a larger number of image defects caused by the offset toner at the cut end portion at the leading end and the trailing end of the recording material is prevented.

Embodiment 3

Figure 10:
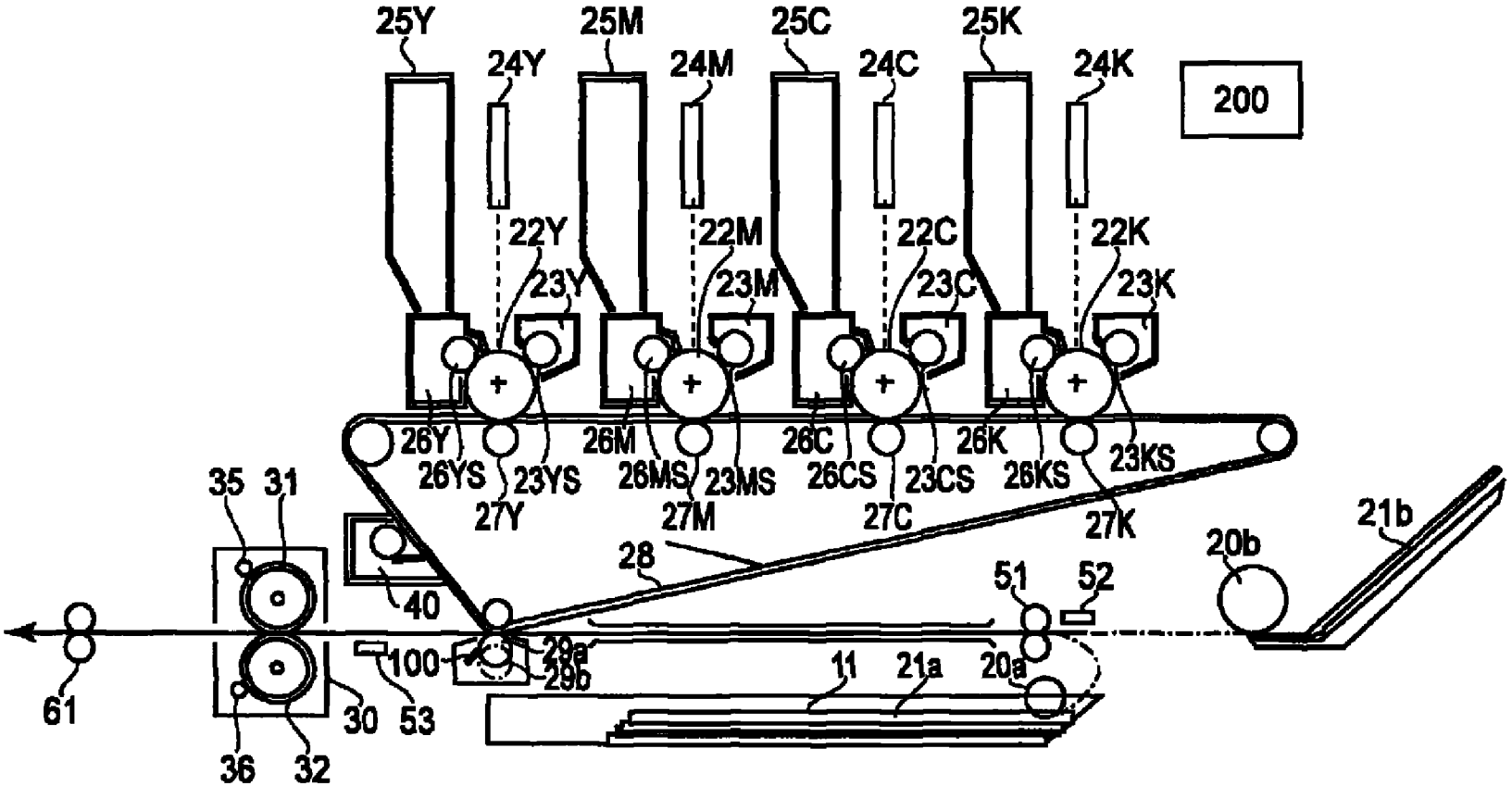
FIG. 10 illustrates an example of the image forming apparatus relating to Embodiment 3.

The image forming apparatus according to Embodiment 3 of the present invention will be described. as shown in FIG. 10, the structures of the image forming apparatus in the present Embodiment 3 are substantially the same as that of Embodiment 1 and Embodiment 2, but are different in the provision of a pre-fixing sensor 53. The pre-fixing sensor 53 is disposed before the fixing portion 30. The pre-fixing sensor 53 is constituted by an LED and a photodetector for detecting the reflected light therefrom, and when the recording material 11 reaches adjacent to the pre-fixing sensor 53, the light is reflected by the LED, and the ON state is detected. The Off state is detected when the recording material 11 is not adjacent to the pre-fixing sensor 53, and the reflected light is not detected. In this embodiment, the difference from Embodiment 1 and Embodiment 2 is in the operation control for the fixing portion 30. In the present Embodiment 3, the result of detection of the pre-fixing sensor 53 is used for the accuracy improvement of contact/spacing timing of the cleaning roller.

Figure 11:
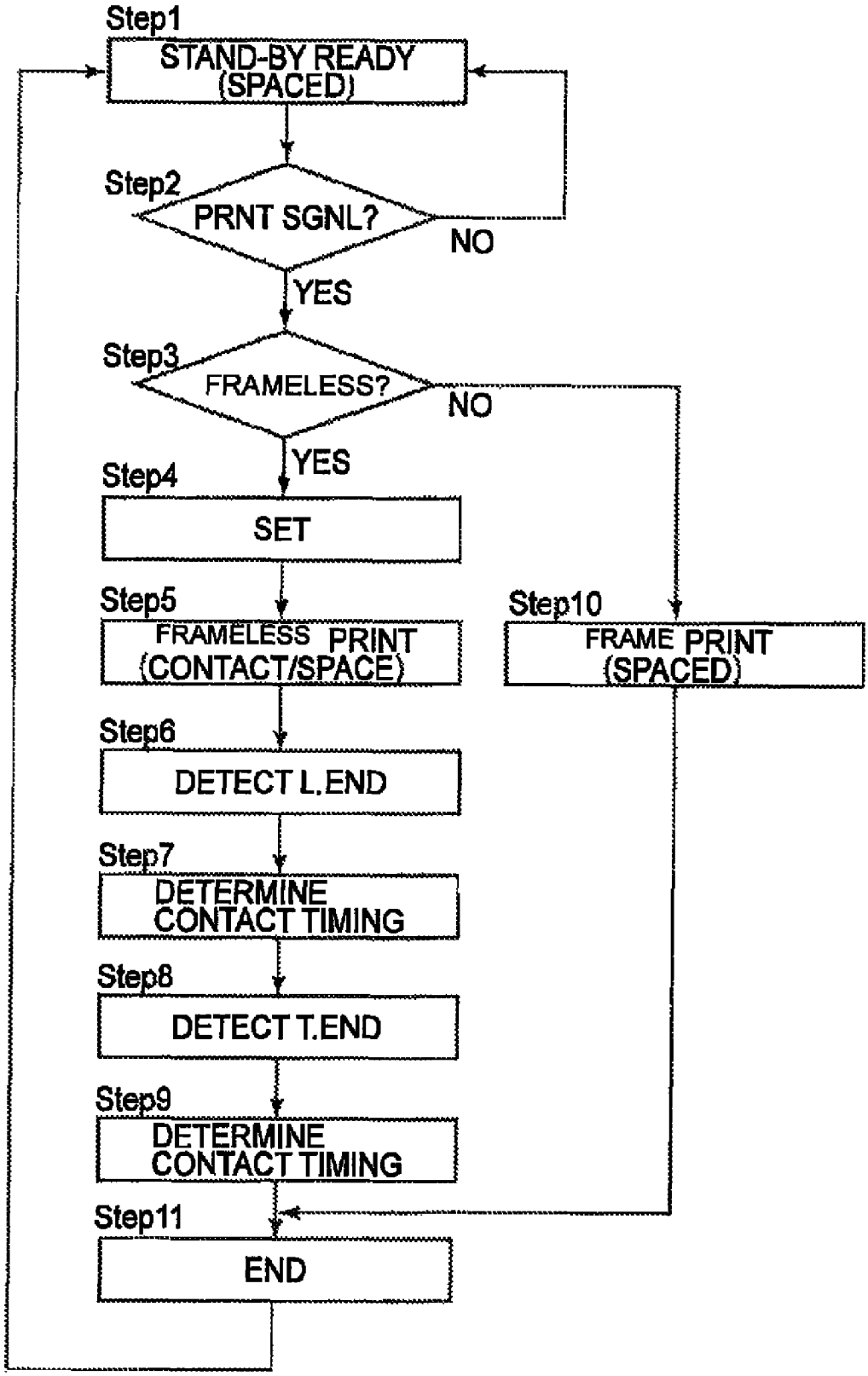
FIG. 11 is a flow-chart illustrating the operation control of the fixing portion relating to Embodiment 3.
Figure 12:
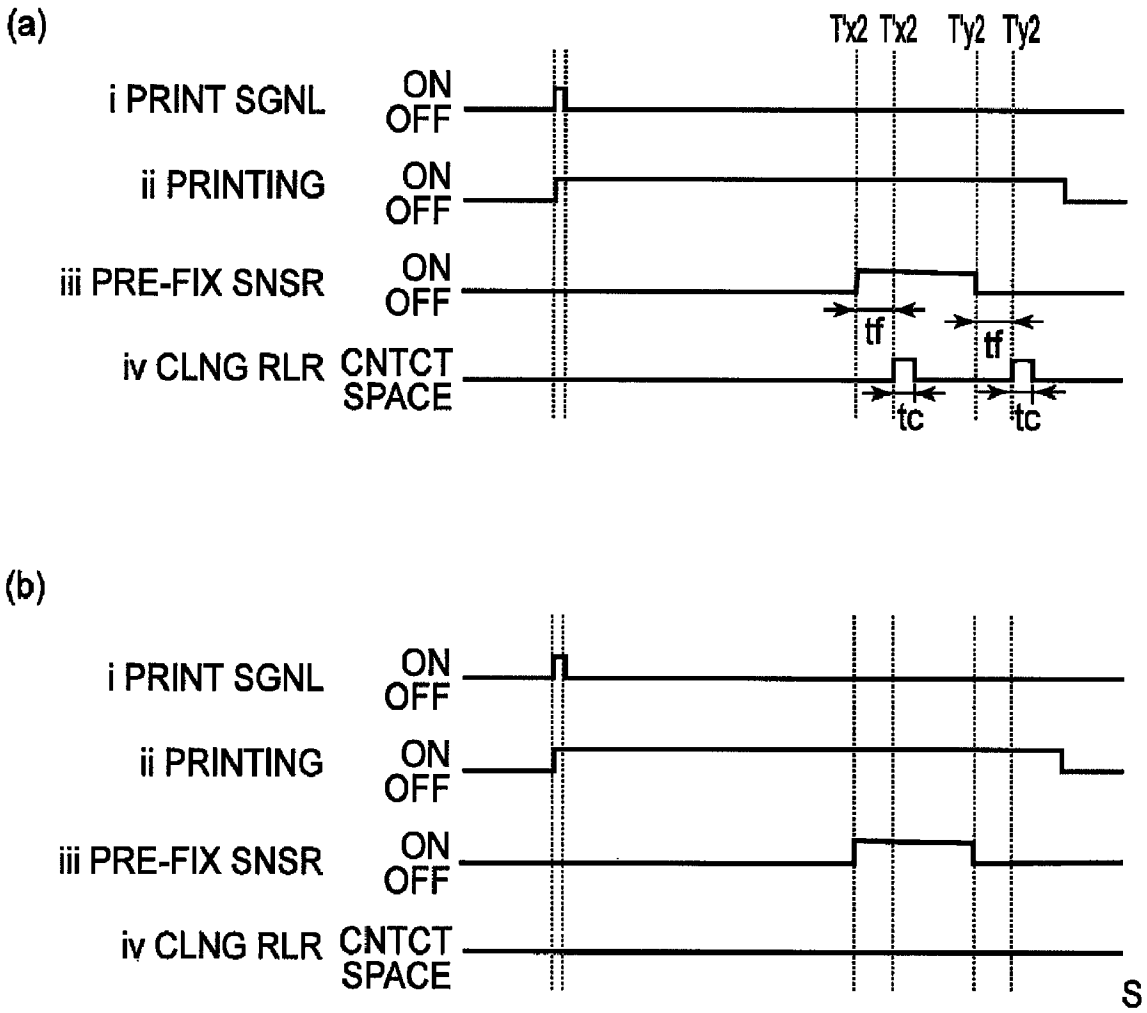
FIG. 12 is a timing chart of the operation control timing of the fixing portion relating to Embodiment 3.

Referring to FIGS. 11 and 12, a description will be provided, as to the operation control of the fixing portion 30 in the image forming apparatus according to Embodiment 3. FIG. 11 is a flow-chart which shows the operation control of the fixing portion 30 in the present Embodiment 3. This control is executed by the CPU 200 which is provided in the image forming apparatus.

Step 1: When the image forming apparatus is in the stand-by ready state, the cleaning rollers 35, 36 are in the spacing state ((*b*) of FIG. 5).

Step 2: The stand-by ready state is continued until the printing signal is received.

Step 3: When the printing signal is received, different control is carried out depending on whether the signal designates the frameless printing mode or designates a blank print mode.

Step 4: In the case where frameless printing mode is designated, CPU200 sets the cleaning roller set times tc, tf. tc is similar to tc in Embodiment 1 and Embodiment 2. Time tf is a constant stored in ROM in CPU200, and it is a feeding time determined on the basis of the length, with respect to the feeding direction, from the contact position of the cleaning rollers 35, 36 to the fixing portion 30 from the pre-fixing sensor 53.

Step 5: The frameless printing operation of the image forming apparatus in this embodiment is executed.

Step 6: After the printing operation execution, the recording material 11 is fed from the feeding portion, and the timing at which the pre-fixing sensor 53 becomes On T'x1 is detected.

Step 7: T'x2 is the timing tf after the timing T'x1.

Step 8: The recording material 11 is fed from the feeding portion 21 after the printing operation execution, and timing T'y1 at which it becomes again Off is detected after the pre-fixing sensor 53 once becomes ON.

Step 9: T'y2 is the timing tf after the timing T'y1.

Step 10: on the other hand, in the case where blank print mode is designated, only the fixing roller 31 and the pressing roller 32 start the rotation, while the cleaning rollers 35, 36 are in the spacing state from the fixing roller 31 and the pressing roller 32, and the printing operation with the blank is executed.

Step 11: When the frameless printing operation or the printing operation with the blank is completed, the operation returns to the stand-by ready state Step1.

FIG. 12 is timing chart which shows the operation control of the image forming apparatus main assembly and the fixing portion 30 in this embodiment. With timing i, until the printing signal is received, the image forming apparatus is in the stand-by state, and the cleaning rollers 35, 36 are in the spacing states. At time i, when the frameless printing mode is set, ((*a*) of FIG. 12) as a result of the CPU 200 the image forming apparatus receiving the printing signal, the image forming apparatus carries out the frameless printing operation at timing ii. At timing iii, the contact/separating operation of the cleaning rollers 35, 36 are controlled at the operation timing shown in Step 4-Step 9 of FIG. 8. By this, based on the result of detection of the pre-fixing sensor 53, the contact timing of the cleaning rollers 35, 36 is determined, and the offset toner of the leading end and the trailing end of the recording material is removed.

At timing i, the CPU 200 in the image forming apparatus receives the printing signal, and as a result, when print mode with the blank is set ((*b*) of FIG. 12), the image forming apparatus carries out the frameless printing operation at timing ii. As described with respect to Step 10 of FIG. 11, the cleaning rollers 35, 36 are normally spaced from the fixing roller 31 and the pressing roller 32. Table 3 shows the defective image incidences per 10000 of the processed recording materials 11 in Embodiment 1, embodiment 2, and Embodiment 3. Here, similarly to the table 2, only the off-set toner contamination of the cut end portions of the leading end and the trailing end of the recording material counts as the image defect. In this embodiment, tc=0.1 sec and tf=0.1 sec.

TABLE 3

| | C. Embodiment 1 | D. Embodiment 2 | E. Embodiment 3 |
|---|---|---|---|
| Image defect incidence per 10000 sheets | 0.25% (25/10000) | 0.08% (8/10000) | 0.02% (2/10000) |

From Table 3, it is understood that the defective image incidence is lower in Embodiment 3 than in Embodiment 1 and Embodiment 2. In this embodiment, the pre-fixing sensor 53 provided just before the fixing portion 30 is used, and the leading end and the trailing end of the recording material is detected thereby. By this, as compared with the control on the basis of the printing signal in Embodiment 1, and the control on the basis of the pre-registration sensor 52 in Embodiment 2, the contact timing, relative to the fixing member, of the cleaning rollers 35, 36 can be controlled with even better accuracy.

As has been described in the foregoing, in the present Embodiment 3, the cleaning control of the cleaning rollers 35, 36 is carried out on the basis of the result of detection of the pre-fixing sensor 53. As a result, the fixing member can be cleaned more correctly and assuredly than in Embodiment 1 and Embodiment 2, and the image defect, due to the offset toner of the cut end portions of the leading end and the trailing end, of the recording material can be prevented. As the frameless printing function, in each of the above-described embodiments, the frameless printing is executed for both the leading end and the trailing end, with respect to the feeding direction, of the recording material, but the present invention is not limited to this, and the frameless printing may be executed only for the leading end or only for the rear end portion, with respect to the feeding direction, of the recording material. Both of the fixing roller 31 and the pressing roller 32 are cleaned by the cleaning rollers 35, 36 in the above-described embodiments, but a cleaning roller which is contacted to and spaced relative to only one of the fixing roller 31 and the pressing roller 32 may be provided to clean only one of the roller surface.

While the invention has been described with reference to the structures disclosed herein, it is not confined to the details set forth, and this application is intended to cover such modification or changes as may come within the purposes of the improvements or the scope of the following claims.

This application claims priority from Japanese Patent Application No. 138291/2009 filed Jun. 9, 2009, which is hereby incorporated by reference.

What is claimed is:

1. An image forming apparatus comprising:

an image forming station configured to form an unfixed toner image on a recording material;

a fixing station configured to fix the unfixed toner image on the recording material, said fixing station including a rotatable member configured to form a fixing nip for nipping and feeding the recording material, and a cleaner, movable toward and away from said rotatable member, and configured to clean said rotatable member, wherein said apparatus is operable in a blankless image formation mode for forming the toner image without a blank space at least at one of a leading end and a trailing end of the recording material, wherein said cleaner contacts said rotatable member at a time at which a portion of said rotatable member that has contacted a blankless region at the leading end or the trailing end of the recording material reaches a position where the portion opposes said cleaner, and wherein said cleaner is spaced from said rotatable member in a period in which a portion of said rotatable member that has contacted the recording medium in a region other than the blankless region passes the position where the portion opposes said cleaner.

2. An apparatus according to claim 1, further comprising a detector, provided in a sheet passage to said fixing station, configured to detect passage of the recording material, wherein contacting said cleaner to said rotatable member and spacing of said cleaner from said rotatable member is controlled in accordance with an output of said detector.

3. An apparatus according to claim 1, wherein said apparatus is operable in a blank-space producing image formation mode for forming the toner image with blank spaces at the leading end and the trailing end of the recording material, and wherein in the blank-space producing image formation mode, said cleaner is maintained in a state spaced away from said rotatable member.

* * * * *